US008331202B2

(12) United States Patent
Martinez et al.

(10) Patent No.: US 8,331,202 B2
(45) Date of Patent: Dec. 11, 2012

(54) MODULAR HOROLOGICAL MOVEMENT

(75) Inventors: Daniel Martinez, La Chaux-de Fonds (CH); Franck-Charles-Cyril Orny, La Chaux-de-Fonds (CH); Johnny Frédéric Girardin, Fontaines (CH)

(73) Assignee: CT Time S.A., La Chaux-de-Fonds (CH)

( * ) Notice: Subject to any disclaimer, the term of this patent is extended or adjusted under 35 U.S.C. 154(b) by 253 days.

(21) Appl. No.: 12/865,528

(22) PCT Filed: Jan. 30, 2009

(86) PCT No.: PCT/EP2009/051053
§ 371 (c)(1),
(2), (4) Date: Oct. 29, 2010

(87) PCT Pub. No.: WO2009/095466
PCT Pub. Date: Aug. 6, 2009

(65) Prior Publication Data

US 2011/0038233 A1 Feb. 17, 2011

(30) Foreign Application Priority Data

Jan. 31, 2008 (EP) ..... 08101185

(51) Int. Cl.
*G04B 19/04* (2006.01)
*G04B 15/00* (2006.01)
*G04B 25/00* (2006.01)

(52) U.S. Cl. ..... 368/80; 368/124; 368/220; 368/223

(58) Field of Classification Search ..... 368/80, 368/124, 127–131, 220, 228
See application file for complete search history.

(56) References Cited

U.S. PATENT DOCUMENTS 4,748,603 A * 5/1988 Ray et al. ..... 368/80
(Continued)

FOREIGN PATENT DOCUMENTS

EP 0 354 194 2/1990
EP 1 826 636 8/2007

OTHER PUBLICATIONS

International Search Report dated May 15, 2009, from corresponding PCT application.

(Continued)

*Primary Examiner* — Vit W Miska
(74) *Attorney, Agent, or Firm* — Young & Thompson

(57) ABSTRACT

The present invention relates to a timepiece movement allowing the arrangement of the various displays to be varied. The movement according to the invention comprises a first module provided both with a first frame and with at least one first wheel assembly mounted rotatably on the first frame, a second module provided both with a second frame and with at least one second wheel assembly mounted rotatably on the second frame, which first and second wheel assemblies are connected kinematically together, positioning means, and, connected to the first and second frames, means for fixing the modules to each other. The positioning means are positioned concentrically with the axis of rotation of either the first or second wheel assembly and are arranged so as to allow relative positioning of the two modules in a plurality of angular positions with reference to the axis of rotation of the wheel assembly with which the positioning means are concentric. According to the invention, either the first or second module is a going-train module (80) comprising a going train and an escape wheel (86), and one of the different wheel assemblies of the going train or the escape wheel (86) may form either the first or said second wheel assembly, while the other of said first and second modules is an escapement-supporting module (87) comprising a lever (89) which may form the other of said two wheel assemblies.

7 Claims, 1 Drawing Sheet

U.S. PATENT DOCUMENTS

| | | | | |
|---|---|---|---|---|
| 5,956,294 | A * | 9/1999 | Takizawa et al. | 368/37 |
| 7,269,101 | B2 * | 9/2007 | Watanabe et al. | 368/28 |
| 7,609,588 | B2 * | 10/2009 | Tokoro et al. | 368/28 |
| 2007/0097794 | A1 | 5/2007 | Suzuki | |
| 2008/0130419 | A1 * | 6/2008 | Watanabe et al. | 368/37 |

OTHER PUBLICATIONS

European Search Report dated Oct. 28, 2008, from corresponding European application.

* cited by examiner

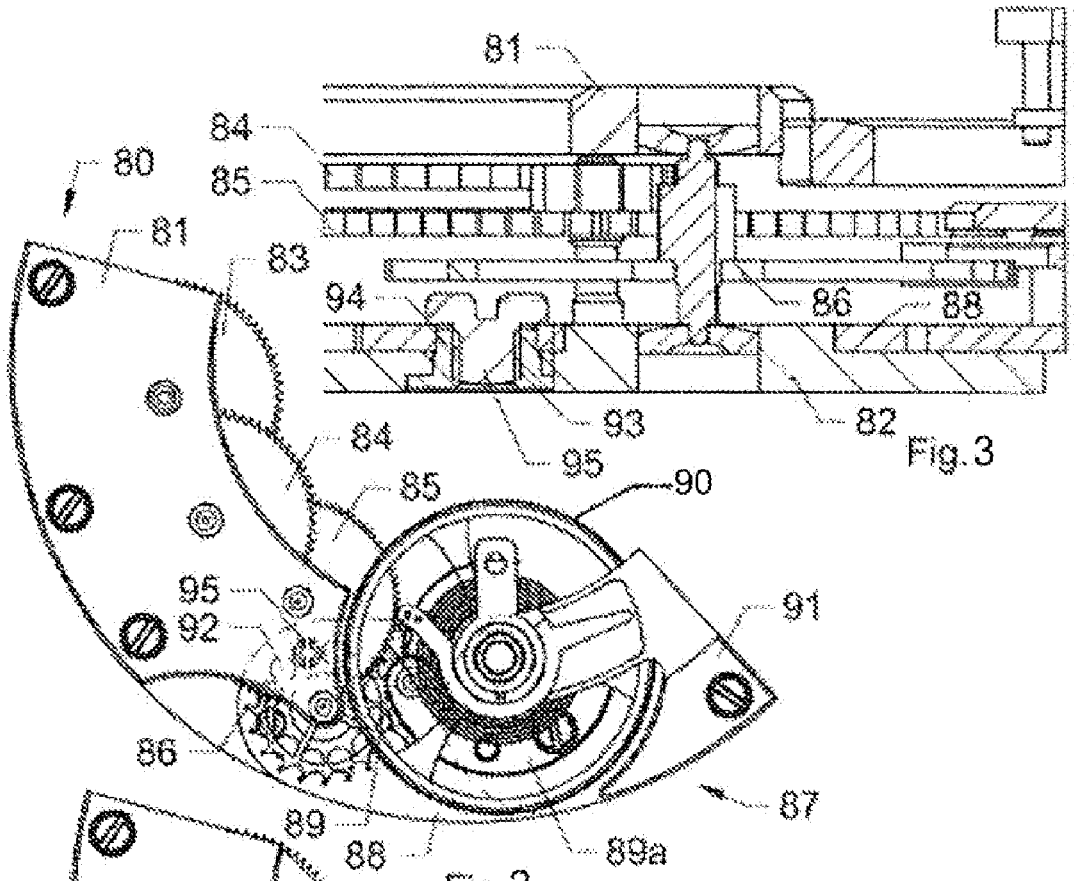
Fig.3
Fig.2
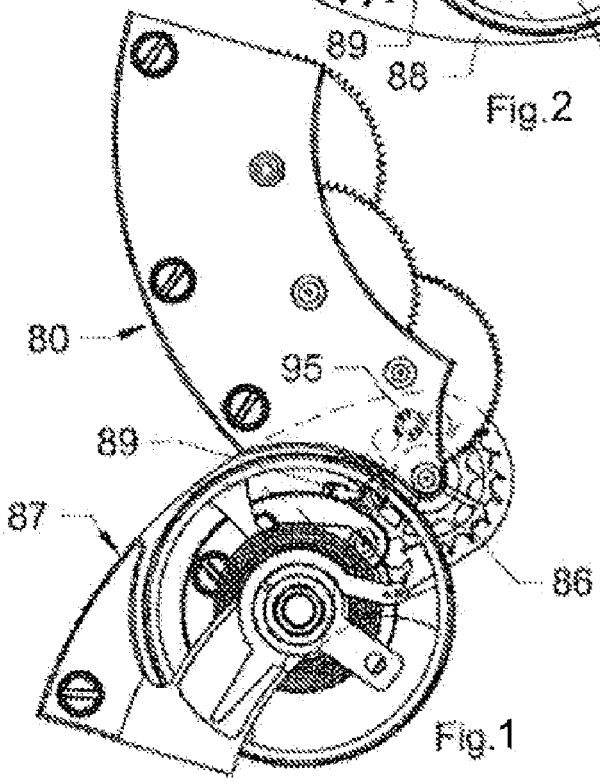
Fig.1

MODULAR HOROLOGICAL MOVEMENT

TECHNICAL FIELD

The present invention concerns a timepiece movement comprising a first module provided with a first frame and at least a first wheel assembly rotatingly mounted on the first frame, a second module provided with a second frame and at least a second wheel assembly rotatingly mounted on the second frame, the first and second wheel assemblies being kinematically connected to each other, positioning means and means for fastening the modules to each other, associated with the first and second frames, said positioning means being arranged concentrically to the axis of rotation of one of said first or second wheel assemblies and being arranged to allow relative positioning of the two modules in several angular positions in reference to the axis of rotation of the wheel assembly to which the positioning means are concentric.

BACKGROUND OF THE INVENTION

Such a timepiece movement is for example shown in patent application EP 0 354 194. This document describes a timepiece comprising a movement forming a first module mounted in a case and including an arbor defining the axis of the movement. This first module comprises a wheel whereof the axis of rotation is the axis of the movement, said wheel constituting the first wheel assembly. The piece also comprises a second module to display the time, and including an arbor defining the axis of the module. This second module comprises a wheel cooperating with the wheel of the movement, and constituting the second wheel assembly. The display module is fastened to the case and to the movement using coupling elements that are arranged symmetrically around the axis of the case in order to allow the axis of the display module to be arranged in different positions having the same eccentricity around the axis of the case.

If the movement manufacturer wishes to differently position elements of the movement other than those of the display module, it is necessary to design another structure of the movement and as a result another plate, the holes of which will have been adapted for this new arrangement. This requires the manufacturer to design, manufacture and store as many plates as there are positioning alternatives of the different elements.

Other solutions have been proposed in order to be able to vary the time display. Thus, "multi-function" plates were developed. Such a plate is for example described in patent application EP 1 826 636. The plate is designed such that different complementary dials and the corresponding display mechanisms can be present or not present on the main dial around hands displaying the time, depending on the manufacturer's wishes. However, this solution requires that the displays one wishes to use always be positioned at the same locations. If one wishes to change the arrangement of the complementary displays, it is again necessary to provide for as many plates as there are positioning alternatives of the different elements.

One aim of the present invention is therefore to offset these drawbacks, by proposing a timepiece movement making it possible to vary the arrangement of the different modules, more precisely of the going train module and the platform escapement module, depending on the manufacturer's wishes, using the same plate, and without having to modify its design.

BRIEF DESCRIPTION OF THE INVENTION

To this end, and according to the present invention, proposed is a timepiece movement comprising a first module provided with a first frame and with at least a first wheel assembly rotatingly mounted on the first frame, a second module provided with a second frame and at least a second wheel assembly rotatingly mounted on the second frame, the first and second wheel assemblies being kinematically connected to each other, positioning means and means for fastening the modules to each other, associated with the first and second frames, said positioning means being arranged concentrically to the axis of rotation of one of said first or second wheel assemblies and being arranged to allow a relative positioning of the two modules in several angular positions in reference to the axis of rotation of the wheel assembly to which the positioning means are concentric.

According to the invention, one of said first and second modules is a going train module comprising a going train and an escape wheel, one of the different wheel assemblies of the going train or of the escape wheel being able to constitute the first, said second wheel assembly, respectively, and the other of said first and second modules is a platform escapement comprising a pallet that can constitute the other of said first, second wheel assembly, respectively.

Thus, the manufacturer then only has a single type of module to manufacture and store. The different movement models can be realized from same first and second modules and differ by modifying the relative positioning of the two modules depending on the different angular positions relative to each other.

Advantageously, said positioning means can comprise a plurality of orifices distributed concentrically to the first wheel assembly, and at least one foot arranged to be able to be engaged in said orifices, the orifices and the foot being arranged some on the frame of the first module, the others on the frame of the second, and arranged to cooperate with the fastening means. In particular, said positioning means can comprise a pillar screw arranged to be engaged in one of the orifices distributed on the frame of the second module and in an orifice provided on the frame of the first module.

According to the alternatives, said orifices can assume the form of continuous oblong annular segments or be discrete, of a shape with axial symmetry, round for instance.

According to one preferred embodiment, the first module is a going train module comprising a going train and an escape wheel, one of the different wheel assemblies of the going train or of the escape wheel being able to constitute the first wheel assembly, and the second module is a platform escapement module comprising a balance and a pallet, which constitutes the second wheel assembly.

The present invention also concerns a timepiece comprising a movement as described above.

BRIEF DESCRIPTION OF THE DRAWINGS

Other features of the present invention will appear more clearly upon reading the following description, done in reference to the appended drawings, in which:

FIG. 1 is a top view of an alternative of a movement according to the invention, FIG. 2 is a view similar to FIG. 1, but the modules being positioned according to a different angle, and FIG. 3 is a cross-sectional view of the modules of FIG. 1.

DETAILED DESCRIPTION OF THE INVENTION

According to the alternative illustrated in FIGS. 1 to 3, the first module is a going train module 80 comprising an upper going train module plate 81 and a lower going train module plate 82, in annular sector form, constituting the first frame. A going train, comprising a center wheel 83, a third wheel 84 and a second wheel 85 and the associated pinions, is rotatingly mounted between the upper 81 and lower 82 going train module plates. The pinion of the center wheel is arranged to mesh with a barrel of a basic movement (not shown).

The going train module 80 also comprises an escapement wheel assembly rotatingly mounted between the upper 81 and lower 82 going train module plates, the escape wheel 86 constituting the first wheel assembly. It is quite obvious that each of the wheel assemblies of the going train module can constitute the first wheel assembly, in particular for example the second wheel assembly.

The second module is formed by a platform escapement 87 and comprises a lower platform escapement module plate 88, a pallet 89 rotatingly mounted between a pallet cock 89*a* and the lower plate 88, and a sprung balance 90 rotatingly mounted between a balance cock 91 and the lower plate 88. The lower plate 88, the pallet cock 89*a* and the balance cock 91 form the second frame, and the pallet 89 constitutes the second wheel assembly. All of these elements are known in themselves and will not be described in more detail.

According to the invention, means are provided for positioning the platform escapement module 87 relative to the going train module 80, arranged concentrically to the escape wheel 86 and arranged to position the platform escapement module 87 around the escape wheel 86 according to different angular positions. Said positioning means comprise a plurality of orifices 92 produced at the end of the lower platform escapement module plate 88, and arranged to be situated concentrically to the escape wheel 86 when the two modules 80 and 87 are assembled, and an orifice 93 provided on the lower going train module plate 82. The orifice 93 has a collar 94 on which the plate of the lower platform escapement module 88 engages such that the orifices 92 and 93 are opposite. The fastening means comprise a pillar screw 95 arranged to be engaged in one of the orifices 92 and in the orifice 93 and to assemble the two modules 80 and 87.

The orifices 92 are discrete, and for example assume the form of circular holes. It is quite obvious that the orifices can also assume the form of continuous oblong segments.

FIG. 2 shows an alternative to FIG. 1 according to which the platform escapement module 87 has been assembled to the going train module 80 according to another angular position relative to the escape wheel 86. For this, another orifice 92 of the lower platform escapement module plate 88 was placed opposite the orifice 93 of the lower going train module plate 82, the modules then being assembled by the pillar screw 95.

This alternative makes it possible to produce movements having a sprung balance 90 in different positions relative to the going train module, using the same modules. Thus, the movement can present different configurations, while using a single plate and modifying a minimum number of pieces.

Moreover, the invention makes it possible to use other types of platform escapement modules. Thus, one obtains a movement with an interchangeable platform escapement module, which can be modified as a function for example of the range of the timepiece.

The invention is obviously not limited to the described example, and it is possible to carry out a reverse construction, i.e. the positioning means can be produced on the going train module concentrically to the axis of rotation of the pallet.

The invention claimed is:

1. A timepiece movement comprising a first module provided with a first frame and at least a first wheel assembly rotatingly mounted on the first frame, a second module provided with a second frame and at least a second wheel assembly rotatingly mounted on the second frame, the first and second wheel assemblies being kinematically connected to each other, positioning means and means for fastening the modules to each other, associated with the first and second frames, said positioning means being arranged concentrically to the axis of rotation of one of said first or second wheel assemblies and being arranged to allow relative positioning of the two modules in several angular positions in reference to the axis of rotation of the wheel assembly to which the positioning means are concentric, wherein one of said first and second modules is a going train module comprising a going train and an escape wheel, one of the different mobiles of the going train or the escape wheel constituting a first, and a second mobile, respectively, and wherein the other of said first and second modules is a platform escapement module comprising a pallet that can constitute the other of said first, second mobile, respectively.

2. The movement according to claim 1, wherein said positioning means comprise a plurality of orifices distributed concentrically to the first mobile, and at least one foot arranged to be able to be engaged in said orifices, the orifices and the foot being arranged some on the frame of the first module, the others on the frame of the second, and arranged to cooperate with the fastening means.

3. The movement according to claim 2, wherein said positioning means comprise a pillar screw arranged to be engaged in one of the orifices distributed on the frame of the second module and in an orifice provided on the frame of the first module.

4. The movement according to claim 2, wherein said orifices are in the form of continuous oblong annular segments.

5. The movement according to claim 2, wherein said orifices are discrete.

6. The movement according to claim 1, wherein the first module is a going train module comprising a going train and an escape wheel, one of the different wheel assemblies of the going train or the escape wheel being able to constitute the first wheel assembly, and wherein the second module is a platform escapement module comprising a pallet constituting the second wheel assembly.

7. A timepiece containing a timepiece movement comprising a first module provided with a first frame and at least a first wheel assembly rotatingly mounted on the first frame, a second module provided with a second frame and at least a second wheel assembly rotatingly mounted on the second frame, the first and second wheel assemblies being kinematically connected to each other, positioning means and means for fastening the modules to each other, associated with the first and second frames, said positioning means being arranged concentrically to the axis of rotation of one of said first or second wheel assemblies and being arranged to allow relative positioning of the two modules in several angular positions in reference to the axis of rotation of the wheel assembly to which the positioning means are concentric, wherein one of said first and second modules is a going train module comprising a going train and an escape wheel, one of the different mobiles of the going train or the escape wheel constituting a first, and a second mobile, respectively, and wherein the other of said first and second modules is a platform escapement module comprising a pallet that can constitute the other of said first, second mobile, respectively.

* * * * *